United States Patent [19]

Johnston et al.

[11] 4,199,900

[45] Apr. 29, 1980

[54] STORM WINDOW UNIT

[75] Inventors: Bobby M. Johnston, Dallas; Billy C. Pope, Garland, both of Tex.

[73] Assignee: Talco Aluminum Company, Inc., Wills Point, Tex.

[21] Appl. No.: 890,413

[22] Filed: Mar. 27, 1978

[51] Int. Cl.[2] ..... E05D 15/06

[52] U.S. Cl. ..... 49/404; 49/63

[58] Field of Search ..... 49/501, 504, 425, 63, 49/62, 404

[56] References Cited

U.S. PATENT DOCUMENTS

| | | | |
|---|---|---|---|
| 3,111,726 | 11/1963 | Grossman | 49/425 X |
| 3,136,396 | 6/1964 | Sullivan | 49/425 |
| 3,487,580 | 1/1970 | Holliday | 49/425 X |
| 3,600,857 | 8/1971 | La Barge et al. | 49/404 |
| 3,908,730 | 9/1975 | Goss, Jr. et al. | 49/63 X |

*Primary Examiner*—Kenneth Downey

*Attorney, Agent, or Firm*—Richards, Harris & Medlock

[57] ABSTRACT

A storm window includes a frame having side jambs interconnected at their upper and lower ends by a head and sill, respectively. The frame receives an upper stationary window sash and a lower movable window sash. Sealing flanges extend inwardly from the side jambs and top rail along the entire length thereof. The flanges are coplanar one with the other. A midbrace is attached between the side jambs intermediate of the head and sill and includes a flange coplanar with the sealing flanges extending from the side jambs and head. The upper stationary sash window has a planar sealing surface around the periphery thereof for sealing engagement against the sealing flanges of the head, side jambs and midbrace. The lower movable window sash has a planar sealing surface around the periphery thereof for sealing engagement against the surface of the sealing flanges of the midbrace and side jambs opposite the surfaces of these members against which the upper stationary window sash seals. The upper stationary window sash is mountable within the storm window frame and retained therein without requiring any retaining structure in addition to the surround frame.

3 Claims, 10 Drawing Figures

STORM WINDOW UNIT

BACKGROUND OF THE INVENTION

1. Field of the Invention

The present invention relates to storm windows and more particularly to a storm window having removable window sashes.

2. Prior Art

The increase in cost of heating and cooling homes and offices during recent years has generated an increased interest in conserving energy by more effectively insulating structures which require heat and cooling. Because substantial heat energy is lost from building structures through windows and doors, the use of storm or insulating windows provide an effective means for conserving energy required to heat and cool building structures and reducing the overall expense in heating and cooling such structures.

In the production of storm or insulating windows of the type which are mounted over existing windows, the primary considerations include providing a storm window which is both structurally sound, yet relatively inexpensive to construct and completely weathertight. These considerations must be fulfilled while also providing window sashes which are removable for cleaning and permitting circulation when desired.

Although storm windows have been produced which provide for removable window sashes and which are structurally rugged in design, the units have not been constructed such that the most advantageous use has been made of materials and standardized mass production techniques while providing a completely weathertight assembly once the removable window sashes are installed within the storm window frame structure. Thus, there has developed a need for a storm window which is both structurally rugged, while providing removable window sashes which are weathertight when assembled within the storm window surround frame without the use of sealing compounds at manufactured joints.

SUMMARY OF THE INVENTION

The present invention provides a storm window unit which overcomes many of the deficiencies of prior art units. The storm window unit includes a frame having first and second side jambs maintained in spaced relationship by a head and sill attached between the first and second side jambs. Sealing flanges extend interiorly from the side jambs and the head and are coplanar one with the other. A midbrace is attached between the side jambs intermediate of the head and sill and includes a sealing flange in the plane of the sealing flanges extending from the side jambs and the head.

A first glass unit is provided for engagement in the frame and has a planar sealing surface around the periphery thereof for sealing engagement against the sealing flanges of the head, side jambs and midbrace. A second glass unit is provided for engagement in the frame having a planar sealing surface around the periphery thereof for sealing engagement against the sealing flanges of the midbrace and side jambs.

Thus, in the present invention, both the first and second glass units seal against flanges which are coplanar. Due to this arrangement, the sealing planes may be more accurately established during construction of the storm window. Thus, the seal provided between the glass units and the storm window frame can be more readily assured than in prior art arrangements.

In accordance with another embodiment of the invention, a first channel is formed in the head having the sealing flange extending from the head as one leg of the first channel. The channel faces interiorly toward the midbrace for receiving the top edge of the frame of the first glass unit. A second channel is formed in the midbrace having the sealing flange extending from the midbrace as one leg of the channel. This channel faces toward the head for receiving the bottom edge of the first glass unit. The legs of the first channel are spaced such that when the top edge of the first glass unit is engaged therein, the sealing surface of the first glass is engaged against the sealing flanges. The legs of the second channel are spaced such that the sealing surface of the first glass unit is engaged against the sealing flange extending from the midbrace when the bottom edge of the first glass unit is engaged in the second channel. Moreover, as a result of this arrangement, the first glass unit may be positively engaged within the storm window frame without additional retaining structure such as clips or screws.

In accordance with still another embodiment of the invention, a second midbrace flange extends upwardly from the midbrace toward the first channel and spaced from the second channel. A flange extends downwardly from the bottom edge of the first glass unit and overlies the second midbrace flange toward the side of the midbrace flange removed from the sealing flange extending from the midbrace. In this arrangement, the overlying of the flange from the bottom edge of the first glass unit over the second midbrace flange provides weather resistance in addition to the seal formed between the first glass unit and the coplanar sealing flanges and first midbrace flange.

In accordance with one embodiment of the invention, the second glass unit is slidable within the storm window frame such that the sealing surface of the glass unit is in slidable engagement against the surfaces of the sealing flanges.

In accordance with still a further embodiment of the invention, a hook flange extends interiorly from the second glass unit toward the first channel and has an opening facing the second channel. The opening of the hook flange is aligned for receiving the first midbrace flange when the second glass unit is in its closed position. Again, this arrangement provides a sealing feature in addition to that seal provided between the first glass unit and the coplanar flanges and midbrace flange against which the movable sash window is mounted.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENT

Figure 1:
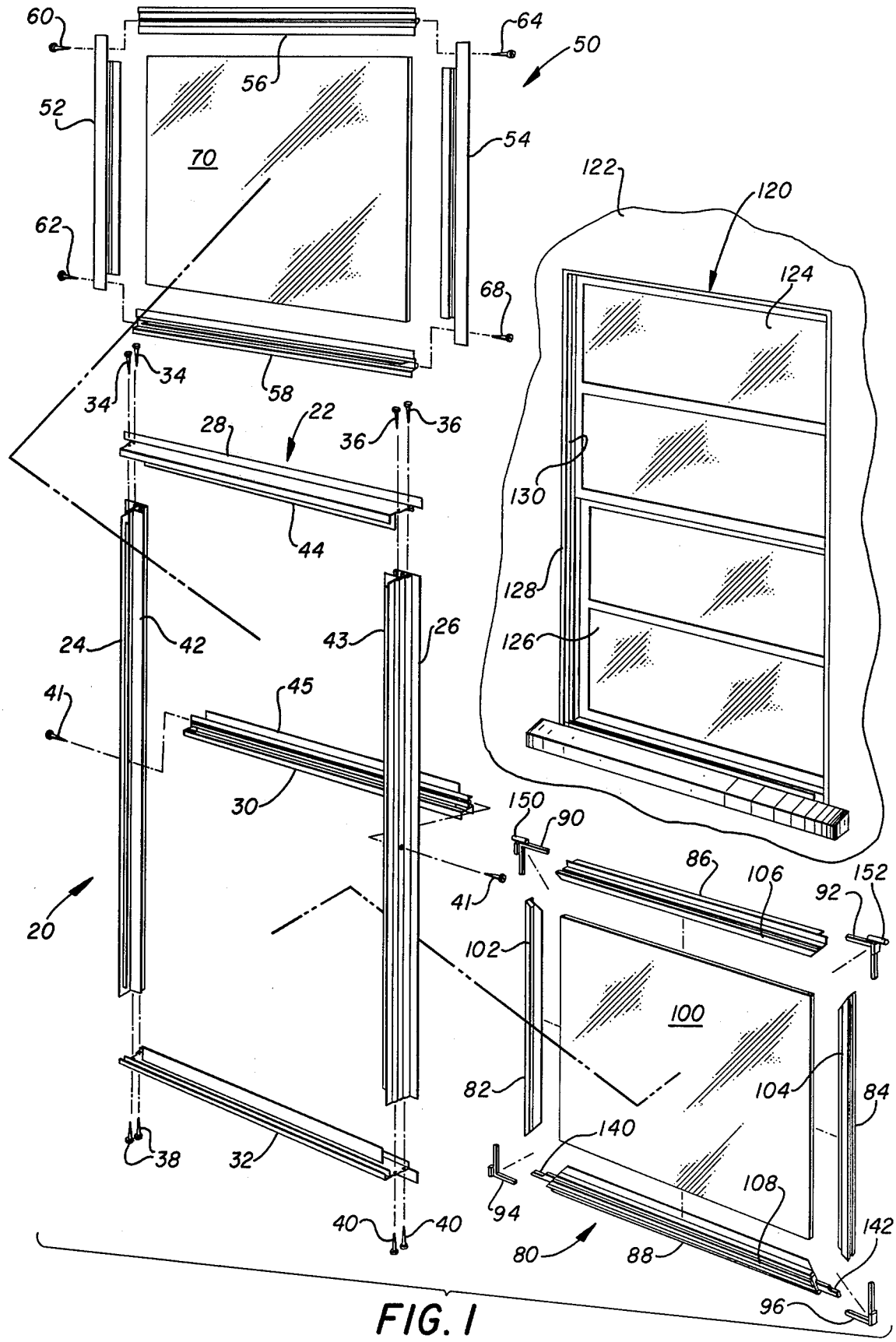
FIG. 1 is a perspective exploded view of the storm window unit of the present invention shown from the outside.

The storm window unit of the present invention is adapted to mate with the primary window surround structure on the outer facing surface of the primary window. Referring now to the drawings and more particularly to FIG. 1, a storm window unit 20 is shown exploded into its various components. Storm window unit 20 includes a frame 22 having a left and right side jamb 24 and 26, respectively, separated by a head member 28, a midbrace 30 and a sill 32. Head member 28 is attached to the left and right side jambs 24 and 26 by screws 34 and 36 while sill 32 is attached to the lower ends of left and right side jambs 24 and 26 by screws 38 and 40. Midbrace 30 is attached between jambs 24 and 26 at a desired position between head member 28 and sill 32 by appropriate screws 41. The assembly of the components of frame 22 forms generally a rectangular casing construction. The side jambs, head and sill members are preferably made of an extruded aluminum or aluminum alloy, although it will be understood that many other materials may be used to form these members. While the attachement of the components to form frame 22 is described as completed by the use of appropriate screws, it will also be understood that other suitable methods of fastening the components are envisioned as alternatives within the scope of the present invention.

Referring still to FIG. 1, each of the side jambs 24 and 26 has an inwardly directed sealing flange 42 and 43, respectively. Likewise, head member 28 has an inwardly directed sealing flange 44 which is in the same plane as the plane of flanges 42 and 43. Midbrace 30 likewise has a sealing flange 45 included therewith which is coplanar with flanges 42, 43, and 44.

Storm window unit 20 further includes an upper stationary sash 50 including a left and right sash stile 52 and 54, respectively, separated by a top and bottom rail 56 and 58, respectively, attached between the ends of stiles 52 and 54. Stile 52 is attached to top and bottom rails 56 and 58 by screws 60 and 62, respectively. Likewise, stile 54 is attached to top and bottom rails 56 and 58 by screws 64 and 68, respectively. A glass pane 70 is fitted within the frame completed by stiles 52 and 54 and top and bottom rails 56 and 58, as will be shown in greater detail hereinafter. As is illustrated in FIG. 1, stationary sash 50 is mountable into frame 22 from the side of the storm window unit facing away from the primary window in which the storm window unit is mounted.

Storm window unit 20 also includes a lower movable sash 80 including left and right side stiles 82 and 84 maintained in a spaced parallel relationship by top and bottom rails 86 and 88. Top rail 86 is attached at its opposite ends to stiles 82 and 84 by angular clips 90 and 92, respectively. Similarly, bottom rail 88 is attached to stiles 82 and 84 by angular clips 94 and 96, respectively. Of course, suitable means other than those described for fastening the components of movable sash 80, as well as the components of upper stationary sash 50, may be employed without deviating from the scope of the present invention. A glass pane 100 is mounted within the frame of movable sash 80, as will be discussed in greater detail hereinafter.

Still referring to FIG. 1, it can be seen that movable sash 80 is removable from frame 22 from the side of the storm window unit facing toward the primary window on which the unit is mounted. FIG. 1 also illustrated the juxtaposition of the storm window unit 20 relative to the structure on which the storm window is mounted. In its normal usage, storm window 20 is adapted for mounting to a primary window 120 which is mounted within a surround structure 122. Primary window 120 normally is constructed with an upper stationary sash 124 and a movable lower sash 126 mounted within a primary window surround frame 128. Substantially all of the aluminum primary windows are also formed to receive a full screen (not shown) which is receivable in a screen mount surface 130 extending around the entire perimeter of the primary window surround frame 128.

Referring still to FIG. 1, movable sash stiles 82 and 84 are fitted with a sealing strip 102 and 104, respectively, extending along the entire longitudinal length thereof. Likewise, top and bottom rails 86 and 88 are fitted with a sealing felt strip 106 and 108 which extends along the entire longitudinal length thereof. Sealing strips 102–108 each face storm window frame 22 and are designed for mating with sealing flanges 42, 43 and 45 of jambs 24 and 26 and midbrace 30, as will hereinafter be discussed in greater detail.

Figure 2:
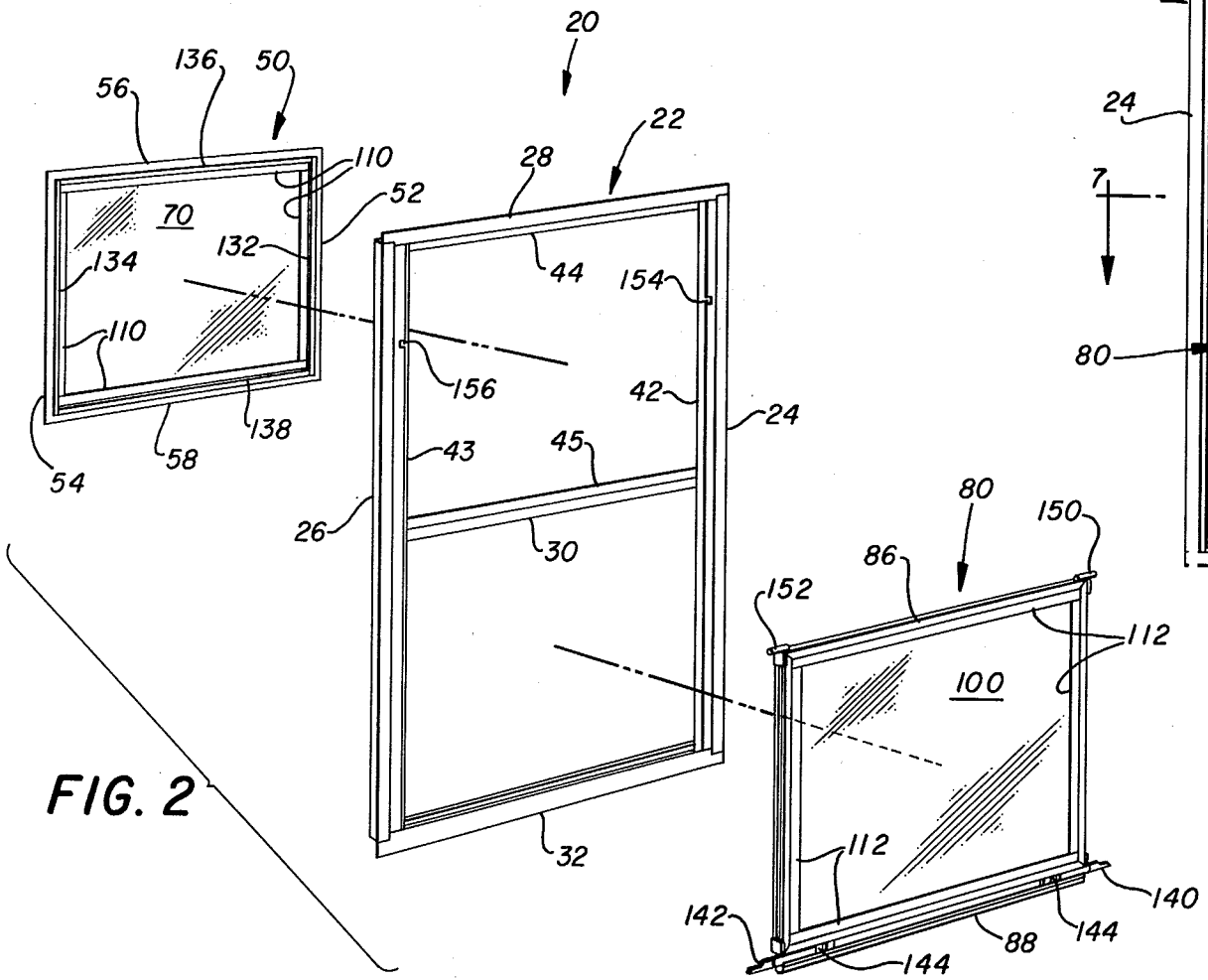
FIG. 2 is a perspective view of the storm window unit of the present invention shown from the inside with the window sashes removed.

FIG. 2 illustrates the storm window unit 20 as viewed from the surface facing inwardly toward the primary window on which the storm window is mounted. The components of frame 22, upper stationary sash 50 and lower movable sash 80 are shown assembled with stationary sash 50 and movable sash 80 separated from their normally mounted position in frame 22. FIG. 2 illustrates the position of retaining strips 110 which are used to complete the assembly of glass pane 70 into the surround frame of upper stationary sash 50. Likewise, retainers 112 are used on movable sash 80 to assist in mounting glass pane 100 within the frame of the movable sash. Referring still to FIG. 2, it can be seen that fixed sash stiles 52 and 54 have a felt sealing strip 132 and 134, respectively, attached the longitudinal length thereof. Likewise, top and bottom rails 56 and 58 also are fitted with a felt sealing strip 136 and 138, respectively, which extends along the entire longitudinal length thereof. Felt strips 132 through 138 are on the face of the frame of stationary sash 50 facing storm window frame 22 and are designed for engagement against sealing flanges 42, 43, 44 and 45, as will hereinafter be discussed in greater detail.

FIG. 2 also illustrates window latches 140 and 142 which are slidably mounted within latch receiving channels 144 of movable sash bottom rail 88. Latches 140 and 142 are spring biased to an extended position as shown in FIG. 2 and selectively engage side jambs 24 and 26 as the movable sash is raised and lowered. Guide pins 150 and 152 are attached to and extend from the outermost ends of top rail 86 of movable sash 80. In one embodiment of the invention, pins 150 and 152 are extensions of angle clips 90 and 92 which secure top rail 86 to sash stiles 82 and 84. Pins 150 and 152 are engageable through notches 154 and 156 within side jambs 24 and 26, respectively, into a channel formed within jambs 24 and 26. Pins 150 and 152 retain the upper portion of movable sash 80 within the frame structure of the storm window unit as sash 80 is moved upwardly or downwardly therein.

Figure 3:
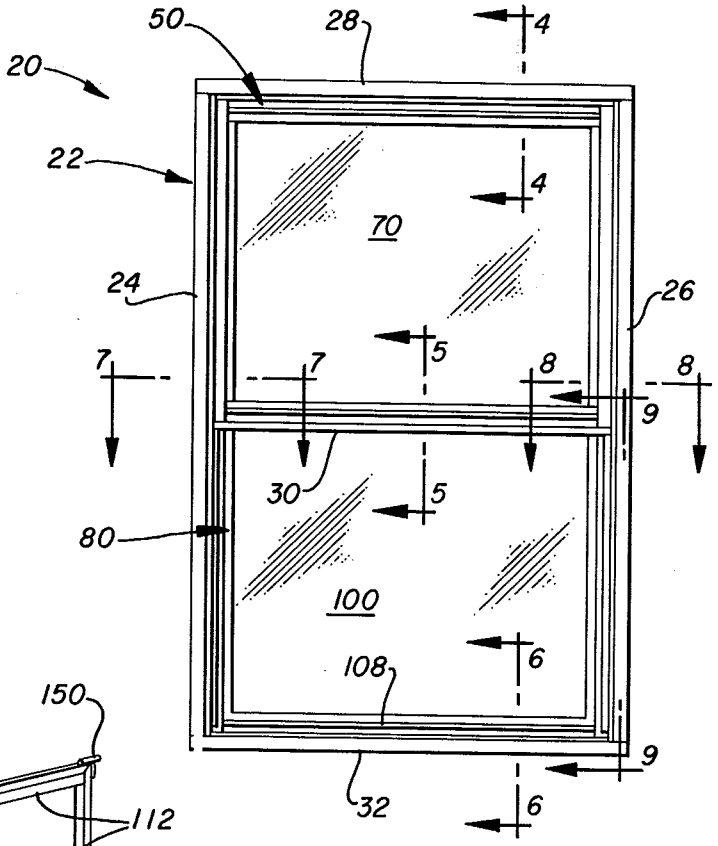
FIG. 3 is a front elevation of the storm window unit of the present invention as seen from the outside showing the window sashes mounted in the surround frame.

FIG. 3 is a plan view of the storm window unit 20 of the present invention as seen from the side of the unit normally facing outwardly from the primary window to which the storm window unit is attached. FIG. 3 illustrates storm window unit 20 having the upper stationary sash 50 and the lower movable sash 80 in place within the surround frame 22.

Figure 4:
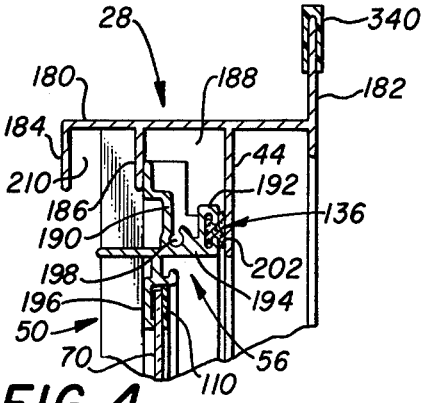
FIG. 4 is a partial vertical section through the storm window frame head, taken along line 4—4 of FIG. 3.
Figure 5:
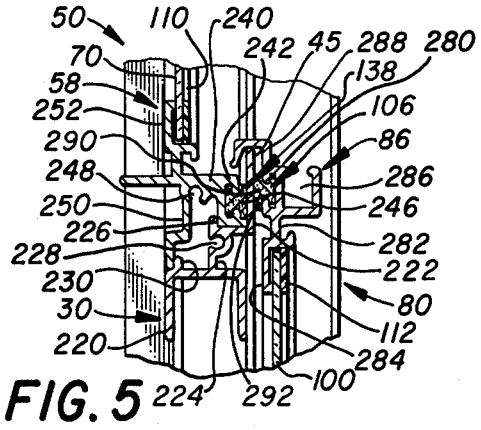
FIG. 5 is a partial vertical section through the central midbrace of the frame, taken along line 5—5 of FIG. 3.
Figure 6:
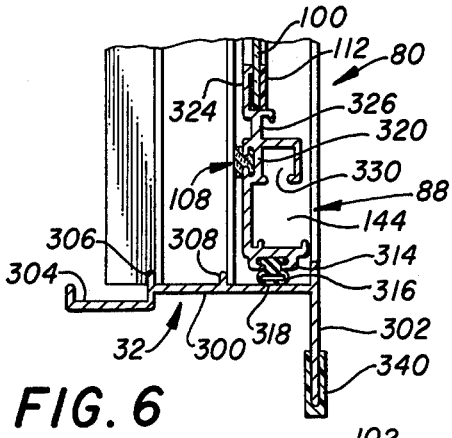
FIG. 6 is a partial vertical section through the sill of the storm window of the present invention, taken along line 6—6 of FIG. 3.

Referring to FIG. 3 in conjunction with the section views taken through the head member, midbrace, and sill, shown in FIGS. 4, 5 and 6, head member 28 includes a headwall 180 having an attachment flange 182 attached at one end thereof substantially in the plane of the storm window unit. Headwall 180 also has interiorly directed flanges 184, 186 as well as sealing flange 44, described and illustrated in FIG. 1. An interiorly facing channel 188 is formed between sealing flange 44 and flange 186 for receiving the fixed sash top rail 56 of stationary sash 50. As can be seen in FIG. 4, top rail 56 includes an exteriorly directed step shaped flange 190 attached to an inwardly facing channel 192 attached to flange 190 by web 194. An interiorly facing glass support flange 196 extends from web 194 and receives the upper edge of glass pane 70, as will hereinafter be discussed in greater detail. A screw boss 198 is formed within web 194 and receives screws 60 and 64 (FIG. 1). Sealing strip 136 is threaded within channel 192 such that its head portion 202 extends beyond channel 192 for mating with sealing flange 44.

As can be seen in FIG. 4, when in its mounted position, top rail 56 mates within channel 188 such that flange 190 and sealing strip 136 are wedged between flanges 186 and sealing flange 44. In this way, a seal is formed between head portion 202 of sealing strip 136 and sealing flange 44.

An interiorly facing screen channel 210 is formed between interiorly facing flanges 184 and 186. This channel is adapted to receive the upper end of a screen structure. This screen structure does not constitute a primary portion of the present invention, and thus is not illustrated herein.

Referring to FIG. 5, midbrace 30 includes a downwardly facing channel 220 with an upwardly facing channel 222 attached thereto by web 224 formed with a bore 228 therein. Upwardly facing channel 222 includes sealing flange 45 as one upstanding leg, and a second upstanding leg 226 opposite and parallel to flange 45. Channel 220 also has a short upstanding flange 230 extending upwardly therefrom.

Referring still to FIG. 5, fixed sash bottom rail 58 includes a web 240 transverse to the plane of the storm window with a channel 242 attached to the inwardly directed end thereof. Channel 242 receives sealing strip 138 having a head portion 246 extending outside of channel 242. Web 240 also has a bore 248 formed therein and a downwardly extending step shaped flange 250 extending therefrom. An upwardly extending glass support flange 252 is attached to web 240 and is in the plane of downwardly extending glass support flange 196 of top rail 56. As can be seen by referring to both FIGS. 4 and 5, glass pane 70 is attached by the use of an adhesive or other means to flanges 196 and 252 of top rail 56 and bottom rail 58, respectively. Retainer strips 110 are attached to flanges 196 and 252 to assist in retaining glass pane 70 within its surround structure.

Referring still to FIG. 5, it can be seen that the thickness of channel 242 and sealing strip 138 as it is mounted therein is slightly larger than channel 222 such that when channel 242 is engaged into channel 222, sealing strip 138 is forced against sealing flange 45. In this way, a positive seal is formed therebetween. Likewise, flange 250 overlays to the outside upwardly extending flange 230 from midbrace 30. In this way, not only is a positive seal effected between sealing strip 138 and sealing flange 45, additional weather resistance is provided by the overlaying of flange 250 over flange 230.

The mounting of upper stationary sash 50 into storm window frame 22 can be best understood by reference to FIGS. 4 and 5. Channel 188 is sufficiently deep to permit the upward engagement of top rail 56 therein and then the successive downwardly engagement of lower bottom rail 58 to midbrace 30. The engagement of bottom rail 58 into midbrace 30 is firmly retained by the compressive engagement of channel 242 and sealing strip 138 into channel 222. Because of the compressive fit of both the top rail 56 and the cooperating sealing strip 136 within channel 188 and a similar compression fit between channel 242 and sealing strip 138 into channel 222, the stationary sash 50 may be engaged into a sealed position without any attachment structure such screws, clips or the like. Thus, the present arrangement for insertion and affixing the upper stationary sash 50 into the storm window of the present invention provides a straight forward and positive assembly of that sash within the frame structure while eliminating the need for any other retaining structure.

Referring still to FIG. 5, the top rail 86 of movable sash 80 includes an outwardly facing sealing strip channel 280 connected by a web 282 to a glass support flanges 284. An upwardly facing channel 286 is attached from the closed side of channel 280 and a downwardly facing hook flange 288 is attached to the upper side leg of channel 280. As can be seen in FIG. 5, downwardly facing hook flange 288 receives sealing flange 45 when the movable sash is in the down or closed position. Sealing strip 106 of felt or other material is received within channel 280 and head portion 292 of sealing strip 106 engages against the inwardly facing surface of sealing flange 45 opposite the surface engaged by sealing strip 138.

Glass pane 100 is attached to glass support flange 284 using a suitable adhesive, and retainer 112 is likewise affixed over glass pane 100 as well as to glass support flange 284.

Referring now to FIG. 6, sill 32 includes a horizontal sill wall 300 having an attachment flange 302 attached at one end thereof. Attachment flange 302 extends both interiorly and exteriorly from sill wall 300. A screen channel 304 is attached to the opposite end of sill wall 300 and is adapted to receive the lower end of a screen where it is used with the storm window unit of the present invention. Two interiorly extending short ribs 306 and 308 are attached to sill wall 300 spaced intermediate of attachment flange 302 and screen channel 304.

Bottom rail 88 of movable sash 80 includes a latch receiving channel 144 with a downwardly facing seal channel 314 attached to the bottom side of latch channel 144. Seal channel 314 receives a flexible sealing strip 316 having an outer portion 318 in the form of a collapsible tubing to form a seal between bottom rail 88 and sill wall 300. An outwardly facing channel 320 is attached to the upper end of latch channel 144 and receives sealing strip 108 therein. A glass support flange 324 extends interiorly in the plane of the glass pane 100 from channel 320 and is attached to channel 320 by web 326. Glass pane 100 is attached by an appropriate adhesive to glass support flange 324 and retainer 112 is likewise secured thereto to retain a glass pane in position. A downwardly facing channel 330 is formed from the inwardly facing leg of channel 320. Channel 330 receives angle clips 94 and 96 (FIG. 1) to attach the bottom rail to the sash stiles during assembly.

As can be seen in FIGS. 4 and 6, a sealing clip 340 may be engaged over the attachment flanges 182 and 302. These clips are usually of a vinyl or plastic material and act as a seal between the attachment flanges and the primary window screen mount structure to which the storm window unit of the present invention is attached. The clips also act as an insulator between the storm window unit surround structure and the primary window structure.

Figure 7:
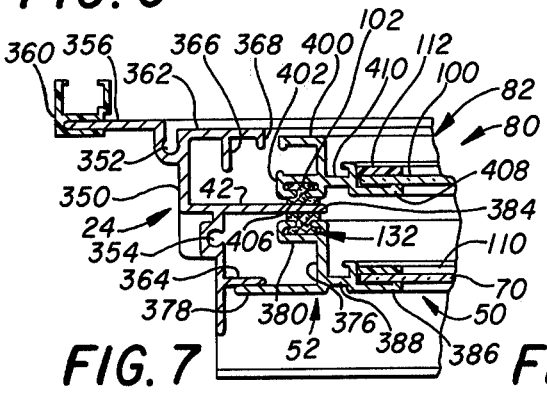
FIG. 7 is a partial horizontal section through a side rail of the storm window as would be seen along line 7—7 of FIG. 3 with lower movable sash 80 raised with its top rail 86 above the section line.
Figure 8:
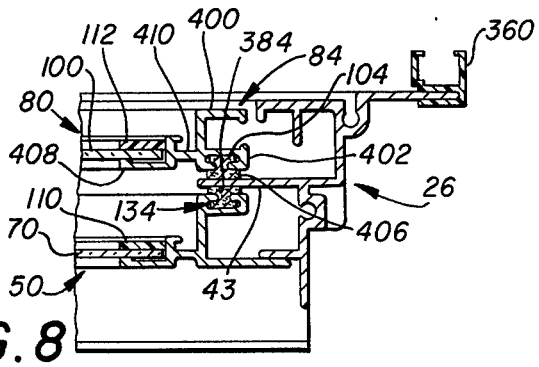
FIG. 8 is a partial horizontal section through the opposite side rail of the storm window as would be seen along line 8—8 of FIG. 3 with lower movable sash 80 raised with its top rail 86 above the section line.

Referring to FIGS. 7 and 8, the engagement of stationary sash 50 and movable sash 80 against side jambs 24 and 26 is shown. As can be appreciated from a review of FIGS. 7 and 8, the section view illustrated in FIG. 7 is a mirror image of the section view shown in FIG. 8. Side jambs 24 and 26 each include a step side wall 350 having two bores 352 and 354 formed therein. These bores receive screws 34 (FIG. 1) in the attachment of head member 28 to side jamb 24. An attachment flange 356 extends transversely from wall 350 outwardly therefrom and substantially in the major plane of the storm window unit. Attachment flange 356 receives a sealing clip 360 which acts as a seal between the attachment flange and the primary screen mount surface to which the storm window unit is attached. Clip 360 also acts as an insulator between the storm window unit surround structure and the primary window structure.

Flanges 362 and 364 extend interiorly from wall 350 and in a plane substantially parallel to the plane of flange 356. Two upstanding legs 366 and 368 extend transversely from flange 362 with leg 366 being taller than leg 368, and a sealing flange 42, seen also in FIG. 1, extends interiorly from wall 350 intermediate of flanges 362 and 364. Flange 42 is substantially longer and extends further inwardly than either of flanges 362 or 364.

Referring still to FIG. 7, and particularly to sash stile 52 of stationary sash 50, stile 52 includes an exteriorly facing channel 376 having one exteriorly facing leg 378 for overriding interiorly facing flange 364. An interiorly facing channel 380 is attached to one leg of channel 376, and receives sealing strip 132. Sealing strip 132 has an outer portion 384 for engagement with sealing flange 42 of said jamb 24. Similarly, in side jamb 26 (FIG. 8), interiorly facing channel 380 receives sealing strip 134 having an outer portion 384 for engagement with sealing flange 43. A glass support flange 386 extends interiorly from and is connected by web 388 to channel 376. Glass pane 70 is attached to flange 386 by appropriate adhesive and retaining strips 110 which are attached to flange 386 and over glass pane 70 to further secure the glass pane to the surround structure.

Stiles 82 and 84 of movable sash 80 include exteriorly facing channels 400 with an outer facing channel 402 having a common side therebetween. Channels 402 are adapted to receive sealing strip 102 on side stile 82 and strip 104 on side stile 84. Sealing strips 102 and 104 have an outer portion 406 for engagement against sealing flanges 42 and 43. A glass support flange 408 extends interiorly from and is attached by way of web 410 from channels 400 and 402. Glass pane 100 is attached at its opposite side edges to glass support flanges 408 and retainers 112 are attached to support flanges 408, overlying the edges of pane 100 to secure the glass to flanges 408.

Figure 9:
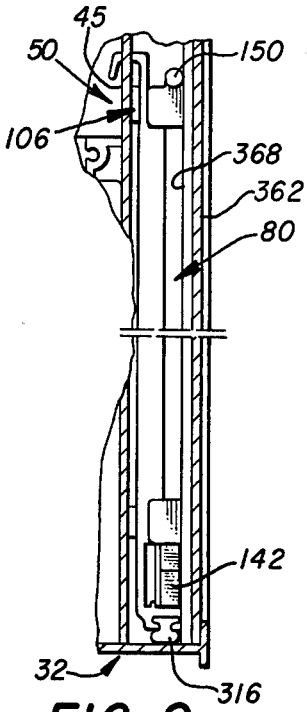
FIG. 9 is a partial vertical section view taken along line 9—9 of FIG. 3.

Referring now to FIG. 9, the upper end of movable sash 80 is retained within the frame by guide pins 150 and 152 when in its mounted position within storm window frame 22. Pins 150 and 152 and inserted through notches 154 and 156 (FIG. 2) and are engaged behind flange 362. Pins 150 and 152 ride against leg 368 extending upwardly from flange 362 and retains sealing strip 106 against sealing flange 45 and sealing strips 102 and 104 in sealing contact with sealing flanges 42 and 43 (FIGS. 7 and 8).

The lower portion of movable sash 80 is also retained in position within surround frame 22 by latches 140 and 142 behind flange 362 which extends inwardly from wall 350 of side jambs 24 and 26. The engagement of latches 140 and 142 within flange 362 also acts to force sealing strips 102 and 104 against sealing flanges 42 and 43 (FIGS. 7 and 8). Sash 80 is locked into a fixed position relative to surround frame 22 by the engagement of latches 140 and 142 through notches (not shown) in leg 366 extending in a plane perpendicular to the longitudinal axis of latches 140 and 142. By moving these latches interiorly, and out of notches in leg 366, sash 80 may be selectively raised or lowered and may be selectively locked into an intermediate position between the completely closed and completely opened position by engaging latches 140 and 142 in selective apertures formed along the longitudinal length of legs 366.

As is shown in FIGS. 4–8, the surfaces of coplanar sealing flanges 42 and 43 extending from side jambs 24 and 26, respectively, sealing flange 44 extending from head member 28 and coplanar sealing flange 45 extending from midbrace 30 are in two parallel planes, on facing inwardly toward the primary window in which the storm window is mounted and one facing outwardly away from the primary window. It may further be appreciated by reviewing FIGS. 4–8 that upper stationary sash 50 is sealingly engaged against the planar surface facing outwardly and formed by the outer facing surfaces of sealing flanges 42, 43, 44 and 45. Further, movable sash 80 is sealingly engaged against the planar surface formed by the inwardly facing coplanar surfaces of sealing flanges 42, 43, and 45. Thus, although the upper stationary sash 50 and lower movable sash 80 seal against flanges which are coplanar, the surface contacted by sashes 50 and 80 to form a seal between the sashes and the storm window frame are the surfaces on opposite sides of the sealing flanges 42, 43, 44 and 45.

Figure 10:
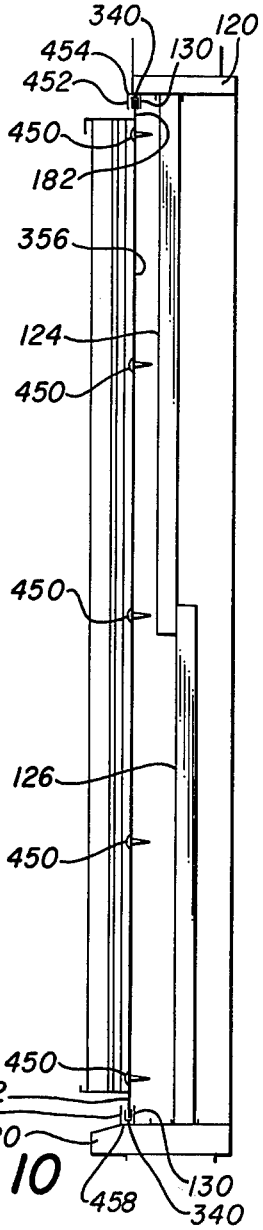
FIG. 10 is a right side elevation of FIG. 3 showing the storm window unit attached to the primary window.

FIG. 10 illustrates a vertical section view taken to one side of the storm window of the present invention and showing the storm window mounted to the primary window. The side attachment flanges 356 are attached by suitable screws 450 to the primary window 120 on the screen mount surface 130. The upper attachment flange 182 and lower attachment flange 302 are engaged behind a donwardly extending lip 452 and an upwardly extending lip 456, respectively. Sealing clips 360 are mounted on attachment flanges 356 and clips 340 are mounted on attachment flanges 182 and 302 to provide an insulating seal between the mounting flanges and the primary window surround structure. Sealing clips 360 on flanges 356 form a seal against the screen mount surface 130 while sealing clips 340 on attachment flanges 182 and 302 provide an insulating seal between the flanges and downwardly extending lip 452 and upwardly extending lip 456, respectively. Alternatively, sealing clips 340 on sealing flange 182 may be formed to seal against surface 454 along the upper portion of primary window 120, and sealing clip 340 on sealing flange 302 may seal against surface 458 at the lower surface of primary window 120.

Because the frame of the present invention is normally made of an alloy metal, such as aluminum, as is the primary window surround structure, sealing clips 340 and 360 provide an insulating barrier to prevent heat transfer by conduction between the storm window surround structure and the primary window surround frame. The clips also form a seal to prevent the passage of air between the storm window frame and the primary window surround frame.

Thus, the present invention provides a storm window including a frame for receiving an upper stationary window sash and a lower movable window sash. Sealing flanges extend interiorly from the sides of the frame and are coplanar one with the other. A midbrace is attached between the sides of the frame and includes a sealing flange in the plane of the sealing flanges extending from the frame. The upper stationary window sash has a planar sealing surface around the periphery thereof for sealing engagement against the face of the sealing flanges facing outwardly from the primary window in which the storm window is mounted. The lower movable window sash is slidably mounted within the storm window frame and has a planar sealing surface around the periphery thereof for sealing engagement against the face of the sealing flanges facing inwardly toward the primary window. Thus, the seal between the window sashes is formed at the outwardly and inwardly facing surfaces, respectively, of sealing flanges which are coplanar one with the other. In this way, the sealing surfaces may be more accurately controlled to assure a more complete weathertight seal between the window sashes and the storm window frame.

Further, the present invention provides structure in the storm window frame for receiving the stationary sash without requiring retaining clips or screws as found in other prior art units.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

What is claimed is:

1. A storm window comprising:

a frame having first and second side jambs maintained in spaced relationship by a head member and sill attached between the first and second side jambs, sealing flanges extending interiorly from the side jambs and the head member, said sealing flanges being coplanar one with the other, a midbrace attached between said side jambs intermediate of said head member and sill, said midbrace including a sealing flange in the plane of said sealing flanges extending from said side jambs and said head member, a first glass unit for engagement in said frame having a sealing surface around the entire periphery thereof in substantially a common plane for sealing engagement of the entire periphery against the sealing flanges of said head member, said side jambs and said midbrace, a second glass unit for engagement in said frame having a sealing surface around the periphery thereof in substantially a common plane for sealing engagement against the sealing flanges of said midbrace and said side jambs, a first channel formed in the head member having the sealing flange extending from the head member as one leg of said first channel, said channel opening interiorly towards said midbrace for receiving the top edge of said first glass unit, a second channel formed in said midbrace having the sealing flange extending from the midbrace as one leg of said second channel, said second channel opening toward said head member for receiving the bottom edge of said first glass unit, a second midbrace flange extending upwardly from said midbrace toward said first channel and spaced from the legs of said second channel, and a flange extending downwardly from the bottom edge of said first glass unit and overlying said second midbrace flange toward the side of said second midbrace flange remote from said sealing flange extending from said midbrace.

2. A storm window having a frame with first and second side jambs connected by a head member and sill and receiving a first and second window sash comprising:

a planar protrusion extending inwardly from the frame continuously along three sides thereof, a midbrace attached between the first and second side jambs of the frame, said midbrace having a planar protrusion extending therefrom in the plane of the planar protrusion from the frame, sealing means attached along the entire periphery of the first window sash for mating continuously along one face of the midbrace and along one face of the planar protrusion from the frame to form a seal between the first window sash and the frame, sealing means attached along the periphery of the second window sash for mating with the face opposite said one face of the midbrace and the planar protrusion from the frame to form a seal between to second window sash and the window frame, a first channel formed in said window frame having the planar protrusion extending from the frame as one leg of said first channel, said channel opening interiorly towards said midbrace for receiving the top edge of said first window sash, a second channel formed in said midbrace having the planar protrusion extending from the midbrace as one leg of said second channel, said channel opening toward said head member for receiving the bottom edge of said first window sash, a second midbrace flange extending upwardly from said midbrace toward said first channel and spaced from the legs of said second channel, and a flange extending downwardly from the bottom edge of said first window sash and overlying said midbrace flange toward the side of said midbrace flange remote from said planar protrusion extending from said midbrace.

3. A storm window having a frame including said jambs interconnected at their upper and lower ends by a head member and sill, respectively, for receiving a first and second glass unit, comprising:

sealing flanges extending inwardly from the side jambs and head member along the entire length thereof, said flanges having a first surface positioned in a first plane and an opposite second surface positioned in a common second plane, a midbrace attached between the side jambs intermediate of the head member and sill having a sealing flange with a first surface in said first plane and an opposite second surface in said second plane, first sealing means attached to a face of the surround structure of the first glass unit along the entire periphery thereof for mating with the first plane surface of said sealing flanges extending from the side jambs and the head member and the first plane surface of the midbrace to form a seal between the first glass unit and the window frame, second sealing means attached to a face of the surround structure of the second glass unit for mating with the second plane surface of the sealing flanges of the side jambs and the second plane surface of the midbrace to form a seal between the second glass unit and the window frame, a first channel formed in the head member having the sealing flange extending from the head member as one leg of said first channel, said channel opening interiorly towards said midbrace for receiving the top edge of the first glass unit, a second channel formed in said midbrace having the sealing flange extending from the midbrace as one leg of said second channel, said second channel facing toward said head member for receiving the bottom edge of the first glass unit, a second midbrace flange extending upwardly from said midbrace toward said first channel and spaced from the legs of said second channel, and a flange extending downwardly from the bottom edge of the first glass unit and overlying said second midbrace flange toward the side of said second midbrace flange remote from said sealing flange extending from said midbrace.

* * * * *

UNITED STATES PATENT AND TRADEMARK OFFICE

CERTIFICATE OF CORRECTION

PATENT NO. : 4,199,900

DATED : April 29, 1980

INVENTOR(S) : Bobby M. Johnston; Billy C. Pope

It is certified that error appears in the above-identified patent and that said Letters Patent are hereby corrected as shown below:

Column 3, line 44, change "attachement" to --attachment--.
Column 4, line 21, change "illustrated" to --illustrates--.
Column 6, lines 36-37, change "such screws" to --such as screws--.
Column 6, line 46, change "flanges 284" to --flange 284--.
Column 7, line 64, change "of said jamb 24" to --of side jamb 24--.
Column 8, line 21, change "and inserted" to --are inserted--.

Column 9, line 4, change "donwardly" to --downwardly--.
Column 10, lines 59 and 60, change "between to second window" to --between the second window--.
Column 11, lines 11-12, change "said jambs" to --side jambs--.

Signed and Sealed this

*Twenty-sixth* Day of *August 1980*

[SEAL]

*Attest:*

SIDNEY A. DIAMOND

*Attesting Officer*

*Commissioner of Patents and Trademarks*